United States Patent [19]

Andrew et al.

[11] Patent Number: 4,915,709

[45] Date of Patent: Apr. 10, 1990

[54] KNIFE SHARPENER

[75] Inventors: Michael A. Andrew, Milford; Thomas G. Siegel, Southbury; Omer Shifflet, Shelton, all of Conn.; James Green, Spencerport; Duane Seaburg, Oakfield, both of N.Y.

[73] Assignee: Black & Decker, Inc., Newark, Del.

[21] Appl. No.: 229,911

[22] Filed: Aug. 8, 1988

[51] Int. Cl.[4] ..... B24B 3/36

[52] U.S. Cl. ..... 51/109 BS; 51/5 B; 51/56 R; 51/181 R; 51/128; 7/158; 76/89

[58] Field of Search ..... 51/5 B, 102, 128, 56 R, 51/109 BS, 168, 181, 208, 210, 285, 238 R, 239; 30/400, 401, 410, 421, 444; 7/158; 76/82, 86, 87, 88, 89

[56] References Cited

U.S. PATENT DOCUMENTS

| | | | |
|---|---|---|---|
| 730,706 | 6/1903 | Rose . | |
| 822,070 | 5/1906 | McLeran | 51/128 X |
| 2,114,106 | 4/1938 | Geveke | 51/210 X |
| 2,898,709 | 8/1959 | Bednarski | 51/128 X |
| 3,034,264 | 5/1962 | McMaster | 51/128 X |
| 3,071,899 | 1/1963 | Hicks et al. | 51/128 |
| 3,412,508 | 2/1966 | Schell . | |
| 3,585,717 | 6/1971 | Bielak et al. | 51/181 R |
| 4,612,731 | 9/1986 | Eckel | 51/56 R |
| 4,716,689 | 1/1988 | Friel . | |
| 4,807,399 | 2/1989 | Friel . | |

FOREIGN PATENT DOCUMENTS

| | | | |
|---|---|---|---|
| 834422 | 2/1970 | Canada | 30/421 |

*Primary Examiner*—Robert P. Olszewski
*Attorney, Agent, or Firm*—Barry E. Deutsch

[57] ABSTRACT

A knife sharpener is disposed adjacent a second electrical appliance of a design family. In an inoperative position, the knife sharpener includes design features mimicking the remainder of the design family. When moved to an operative position, the knife sharpener makes its sharpening wheel accessible to the edges of a knife blade. An energizing switch is coordinated for actuation as the knife sharpener reaches its operational position. In a combination that uses the same electric motor to drive the knife sharpener and a second appliance, different motor speeds are produced appropriate for the two functions to be performed. A bi-directional spring loading assembly permits deflection of the sharpening wheel in opposed lateral directions from a positively controlled neutral position to maintain substantially uniform application of sharpening force on the knife edges. An articulating knife guide permits the use of a single guide slot which can be inclined on either side of the sharpening wheel. An integral detent spring ensures that the guide slot may remain in only permitted inclinations.

10 Claims, 13 Drawing Sheets

KNIFE SHARPENER

BACKGROUND OF THE INVENTION

The present invention relates to kitchen appliances and, more particularly, to motor-driven kitchen appliances.

A present trend in kitchen appliances includes designs especially adapted for suspending below kitchen cabinets, whereby such appliances are suspended clear of working surfaces below the cabinets. A product family of such suspended appliances is sold by the assignee of the present invention under the trademark Spacemaker.

Suspending an appliance below a cabinet denies access to the top of the appliance. Thus, in the case of a coffee maker or a popcorn popper, special means are required to permit administering coffee and water (in the case of a coffee maker) or unpopped kernels (in the case of a popcorn popper) through the front of the appliance.

The present invention is directed toward motor-driven knife sharpeners. A conventional knife sharpener rests upon a countertop and contains an electric motor driving a grinding wheel located near the top thereof. A pair of angled slots in the top of the knife sharpener guide a knife so that its edge contacts the side surfaces of the grinding wheel. Direct under-cabinet mounting denies access to the top slots in a conventional knife sharpener.

Although such a knife sharpener could be suspended far enough below the cabinet to permit access to top slots therein, styling considerations make this undesirable in some devices. The styling considerations arise because the knife sharpener of the present invention is only one member of a unified family of kitchen appliances. One characteristic of a successful unified family of appliances is a uniform facade, wherein each member of the family presents a unified facade blending with the remaining members of the family. In the present instance, it is determined that the other members of the family are suspended directly below the cabinets, without significant space above. Accordingly, mounting a knife sharpener with enough headroom to permit top access for inserting a knife blade would depart from the desired unified facade.

Some prior-art knife sharpeners are built in a combination which also includes a can opener. One side of the combination appliance includes the accessories for opening a can, and the other includes angled slots giving access to a grinding wheel. Both parts of the appliance are conventionally driven by a single electric motor. The motor speeds for the can-opening and knife-sharpening functions are preferably different. In most combination devices, the can opener is driven by a shaded pole motor running about 1500 RPM through reduction gearing, whereas the knife sharpener grinding wheel is connected directly to the motor shaft. An optimum speed for knife sharpener is about 5,000 feet per minute. A motor speed of 1500 RPM, suitable for driving the gearing of the can opener, drives the grinding wheel of the knife sharpener at a speed that is lower than the optimum. The economies gained from requiring only a single motor have encouraged manufacturers to accept the resulting compromise, even though the knife-sharpening function is not as effective as it could be.

A knife sharpener of the type having a rotating grinding wheel should be contacted by the knife edge with a uniform predetermined constant force. This objective is rarely attained. As the user inserts the knife blade through slot and into contact with the grinding wheel, the user may exert too much or too little force for satisfactory sharpening. If too little force is applied, the sharpening time is extended unnecessarily. If too much force is applied, the knife edge can be burned. Also, as the user moves the knife back and forth in the slot, and tilts the knife to accommodate curves in the cutting edge, a varying force can produce uneven metal removal.

Prior-art devices rely on a small amount of end play in the rotor of the driving motor combined with the tendency of such rotors to be centered by the magnetic field therein. Unfortunately, the available end play is too small, and the force constant is too variable to offer much of a solution to the problem of maintaining a constant grinding force.

OBJECTS AND SUMMARY OF THE INVENTION

Accordingly, it is an object of the invention to provide a knife sharpener that overcomes the drawbacks of the prior art.

It is a further object of the invention to provide a knife sharpener as a member of a family of under-cabinet suspended appliances.

It is a still further object of the invention to provide a knife-sharpener/can-opener combination appliance suitable for under-cabinet mounting.

It is a still further object of the invention to provide a knife-sharpener/can-opener combination appliance wherein different speeds are selected by actuation of controls for the respective parts of the appliance.

It is a still further object of the invention to provide a knife-sharpener integrated with an accompanying appliance, wherein the knife sharpener is rotated from a storage position to an operational position. In the operational position, one or two slots are made accessible for access by a knife blade. An associated switch is actuated as the knife sharpener is rotated into the operational position.

It is a still further object of the invention to provide a knife sharpener integrated with a second motor-driven electric appliance. The knife sharpener and the second electrical appliance share a single electric motor. The knife sharpener is movable between a storage position and an operational position. Separate electrical actuation of the single electric motor is provided for the knife sharpener and the second electrical appliance. The motor speed is controlled to two different values according to which appliance is actuated.

It is a still further object of the invention to provide a knife sharpener having bi-directional spring loading of a sharpening wheel. The spring loading provides substantially constant grinding forces at all permitted approaches of a knife blade to the sharpening wheel.

Briefly stated, the present invention provides a knife sharpener adapted for disposition adjacent a second electrical appliance of a design family. In an inoperative, stowed, position, the knife sharpener includes design features mimicking the remainder of the design family. When moved to an operative position, the knife sharpener makes its sharpening wheel accessible to the edges of a knife blade. An energizing switch is coordinated for actuation as the knife sharpener reaches its operational position. In a combination that uses the same electric motor to drive the knife sharpener and a second appliance, different motor speeds are produced appropriate for the two functions. A bi-directional spring loading assembly permits deflection of the sharpening wheel in opposed lateral directions to maintain substantially uniform application of sharpening force on the knife edges. An articulating knife guide permits the use of a single guide slot which can be inclined on either side of the sharpening wheel. An integral detent spring ensures that the guide slot may remain in only permitted inclinations.

According to an embodiment of the invention, there is provided a sharpener comprising: means for supporting the sharpener, the means for supporting including means for permitting the sharpener to be rotated between first and second positions, the sharpener including a sharpening wheel therein, at least one angled slot permitting access of a blade to the sharpening wheel, the first position being a non-operative position in which the at least one slot is inaccessible to a user, and the second position being an operative position in which the at least one slot is accessible to the user.

According to a feature of the invention, there is provided apparatus for energizing a motor comprising: the motor being connected for driving first and second electric appliances, first means for energizing the electric motor for the first appliance, second means for energizing the electric motor for the second appliance, and the first means for energizing including means for driving the electric motor at a different speed than the second means for energizing.

According to a further feature of the invention, there is provided an electric sharpener comprising: an electric motor, a shaft on the electric motor, a sharpening wheel, means for rotating the sharpening wheel by the shaft, means for guiding a blade selectively to first and second surfaces of the sharpening wheel, contact between the blade and the first surface being disposed to apply axial force to the sharpening wheel in a first axial direction, contact between the blade and the second surface being disposed to apply axial force to the sharpening wheel in a second axial direction opposite to the first axial direction, means for permitting the sharpening wheel to translate substantial distances in the first and second axial directions, first resilient means for urging the sharpening wheel in the first axial direction, the first resilient means including means for limiting an action of the first resilient means in the first direction to a distance effective to position the sharpening wheel at a nominal position with respect to the at least one slot, second resilient means for urging the sharpening wheel in the second axial direction, the first resilient means including a first spring constant, the second resilient means including a spring constant, the second resilient means being effective for resisting motion of the sharpening wheel when the sharpening wheel is displaced from the nominal position in the first direction, and the first resilient means being effective for resisting motion and the second resilient means being effective for encouraging motion of the sharpening wheel when the sharpening wheel is displaced from the nominal position in the second direction.

According to a still further feature of the invention, there is provided an electric sharpener comprising: a sharpening wheel, a reciprocating assembly, the reciprocating assembly including a slot, means for disposing the slot at first and second inclined positions with respect to the sharpening wheel, the first position permitting contact between a blade and a first surface of the sharpening wheel, and the second position permitting contact between the blade and a second surface of the sharpening wheel.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
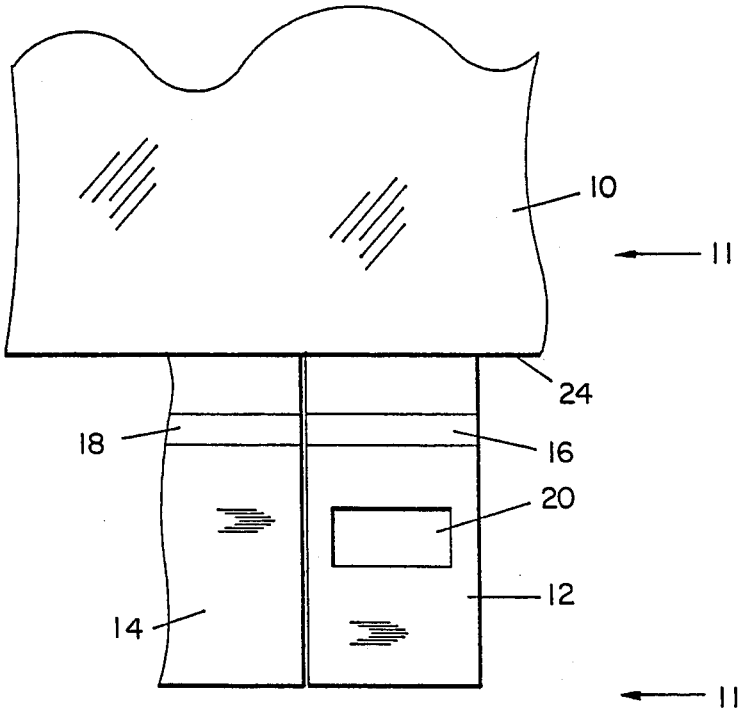
FIG. 1 is a front view of an electric knife sharpener in its storage position disposed adjacent a second appliance in an under-cabinet family.

Referring first to FIG. 1, a cabinet 10 is shown having suspended therebelow a knife sharpener 12 disposed adjacent a second electrical appliance 14. Although not strictly necessary to the practice of some aspects of the present invention, for concreteness of description, it may be presumed that second electrical appliance 14 is a can opener, and it will be so referred to in the following description.

Knife sharpener 12 and can opener 14 share with the family of appliances to which they belong, certain design features such as, for example, their height, frontal contour and, for example decorative stripings 16 and 18. A finger-grip opening 20 in the front of knife sharpener 12 permits access by a user for moving knife sharpener 12 between an inoperative position shown in FIG. 1 and an operative position to be described hereinbelow. It will be noted that the tops of knife sharpener 12 and can opener 14 are disposed closely below the bottom 24 of cabinet 10, thereby denying access to a top surface of knife sharpener 12.

Figure 2:
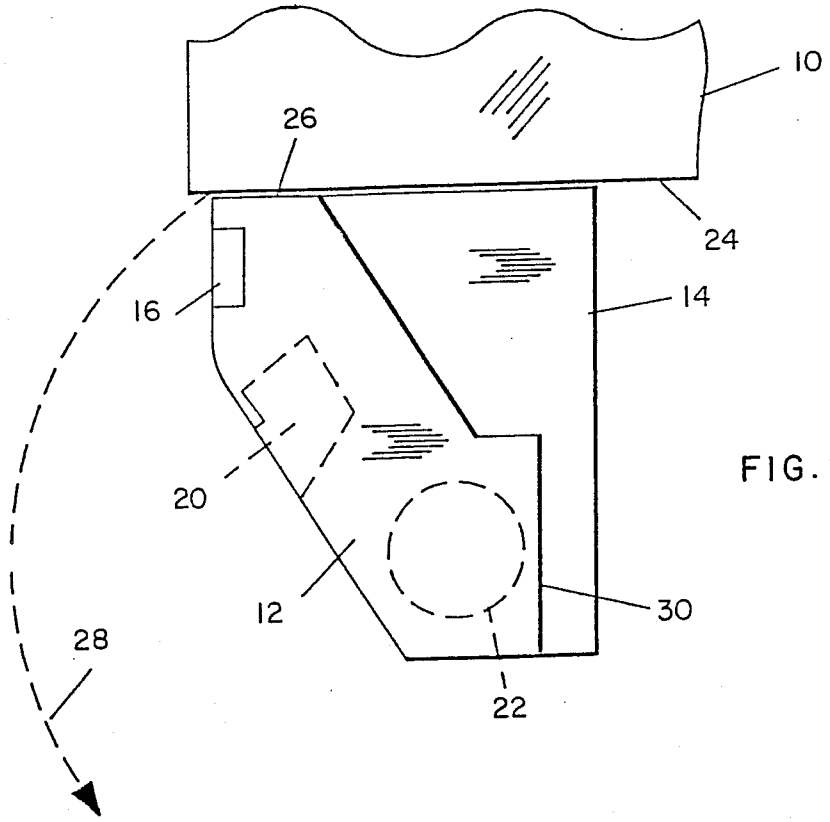
FIG. 2 is a side view of the electric knife sharpener of FIG. 1 in the direction II—II in FIG. 1.

Referring now to FIG. 2, a side view of knife sharpener 12 and can opener 14, with knife sharpener 12 in its inoperative position, reveals that a sharpening wheel 22, shown in dashed line, is disposed a substantial distance below a bottom 24 of cabinet 10. A top 26 of knife sharpener 12 is rotatable about an axis of sharpening wheel 22, as indicated by a dashed arc 28.

Figure 3:
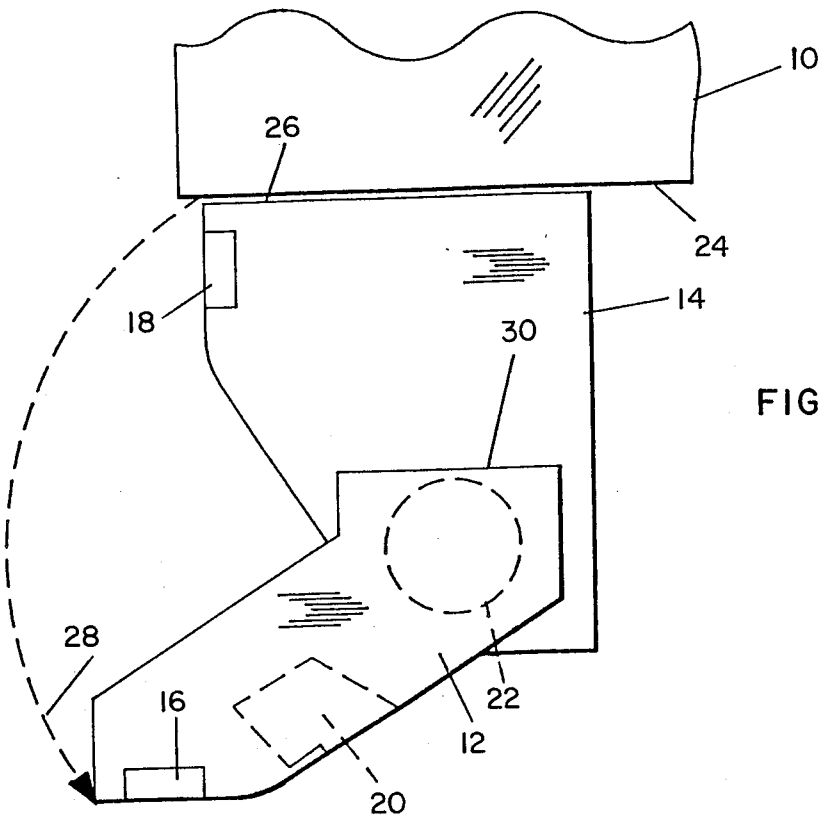
FIG. 3 is a side view of the electric knife sharpener of FIG. 1 rotated into its operational position.

Referring now to FIG. 3, knife sharpener 12 is shown rotated into its operative position. A slotted surface 30 is now disposed above sharpening wheel 22 and spaced a sufficient distance below bottom 24 to permit access thereto by a knife blade (not shown in FIG. 3). When a sharpening operation is completed, knife sharpener 12 is rotated back to the inoperative position of FIG. 2.

Figure 4:
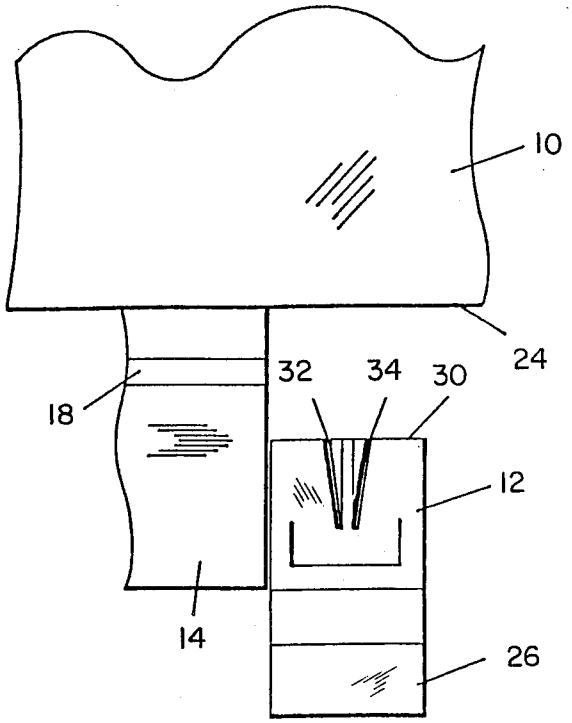
FIG. 4 is a front view of the electric knife sharpener of FIG. 3.

Referring now to FIG. 4, a better view is presented of the spacing between slotted surface 30 and bottom 24. First and second angled slots 32 and 34 permit entry of the blade of a knife (not shown) for sharpening of its cutting edge. The view in FIG. 4 also reinforces the concept that knife sharpener 12 is supported by, and rotates with respect to, can opener 14.

Figure 5:
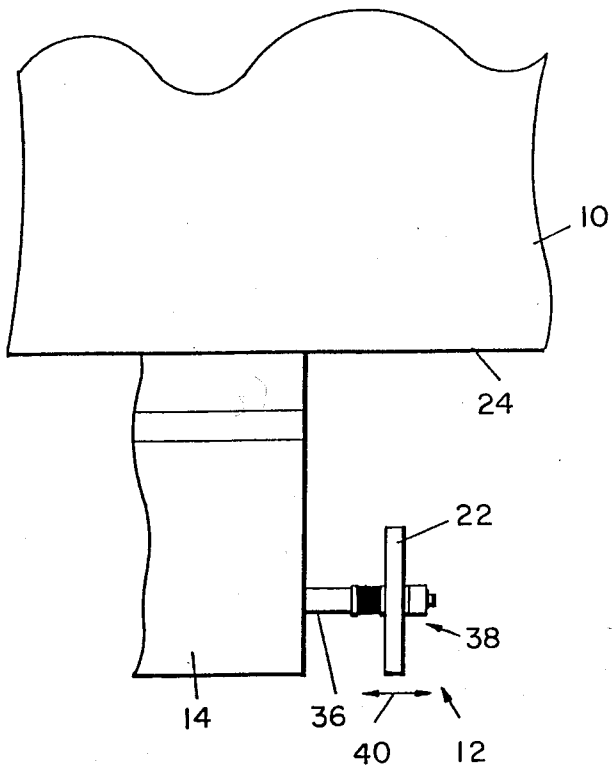
FIG. 5 is a front view of the electric knife sharpener with its housing removed to reveal internal components.

Referring now to FIG. 5, knife sharpener 12 is shown with its housing removed to reveal internal details in support of the ensuing discussion. A shaft 36 extends from can opener 14 for applying rotational torque to sharpening wheel 22. A bi-directional spring-loading assembly, indicated generally at 38, permits axial displacement of sharpening wheel 22 in response to lateral forces applied to the sides of sharpening wheel 22, as indicated by a double-headed arrow 40. As will be fully developed hereinafter, in the absence of side forces, sharpening wheel 22 is returned to a positive neutral position by bi-directional spring-loading assembly 38.

Figure 6:
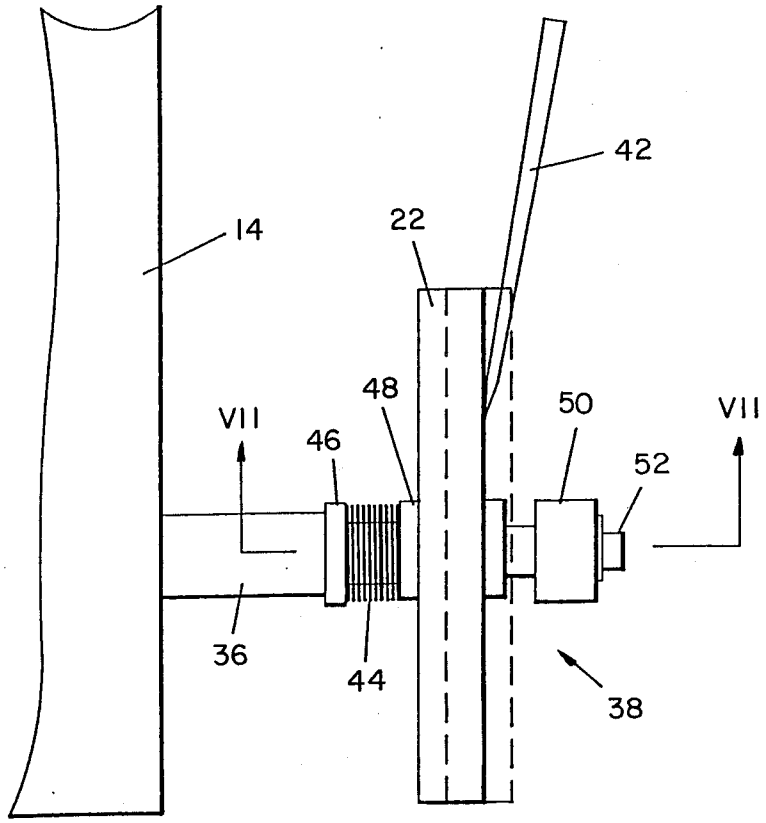
FIG. 6 is a close-up view of the electric knife sharpener of FIG. 5, wherein deflection of the sharpening wheel by a knife blade is illustrated.

Referring now to FIG. 6, an axial force applied to a side surface of sharpening wheel 22 by contact with a knife blade 42 displaces sharpening wheel 22 from its neutral position, shown in dashed line, to a displaced position, shown in solid line. Such displacement is permitted by a spring 44 captured between a disk 46 made fast to shaft 36, and a hub 48 of sharpening wheel 22. A cup 50 disposed on an extension 52 of shaft 36 provides for displacement of sharpening wheel 22 in the opposite direction.

Figure 7:
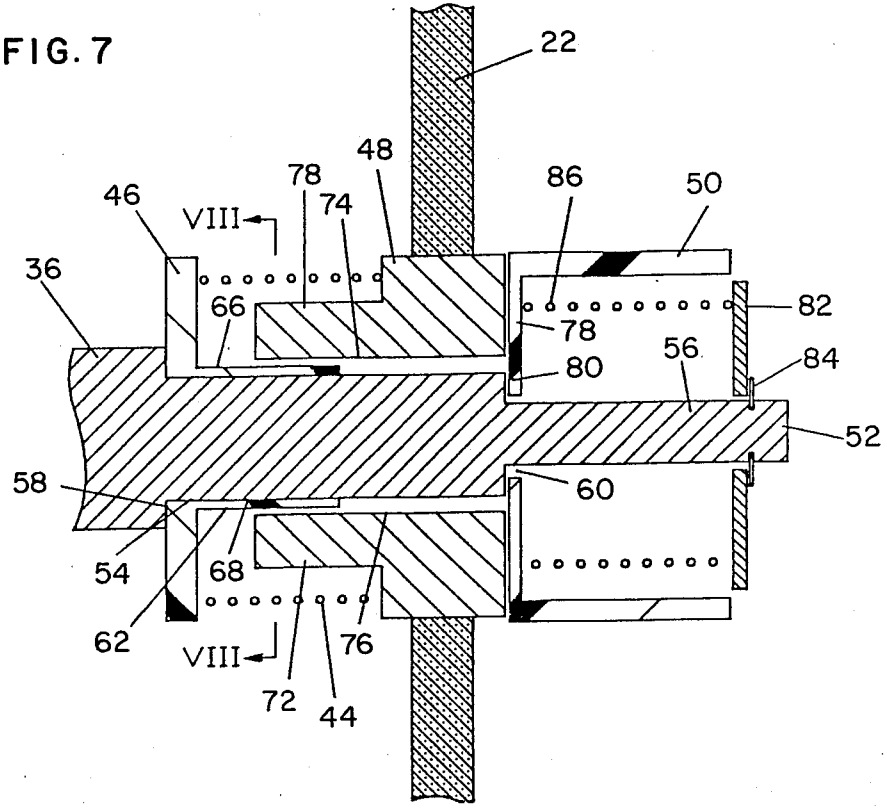
FIG. 7 section taken along VII—VII in FIG. 6.
Figure 8:
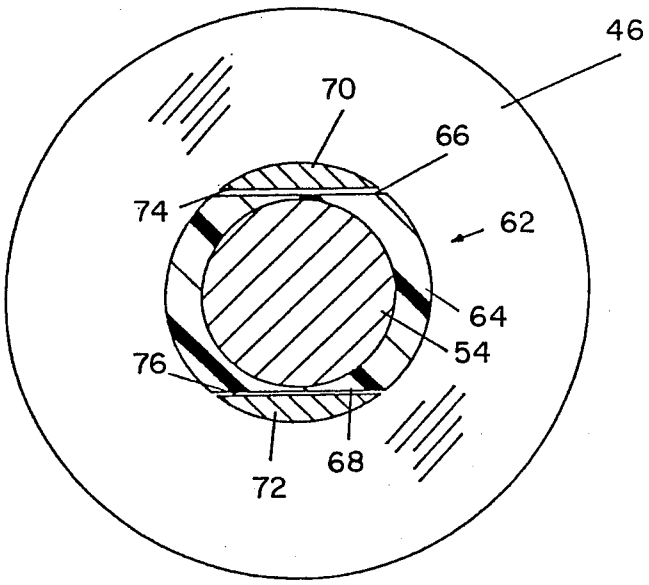
FIG. 8 is a cross section taken along VIII—VIII in FIG. 7.

Referring now to FIG. 7, shaft 36 includes first and second step reductions 54 and 52 to produce first and second abutment shoulders 58 and 60, respectively. Disk 46 is part of a sliding coupling 62, better seen in FIG. 8, to which reference is now also made. A sleeve 64 is affixed to rotate with shaft 36. Sleeve 64 includes first and second flats 66 and 68. Hub 48 includes first and second extensions 70 and 72 having flats 74 and 76 overlying flats 66 and 68, respectively. Torque is transmitted from step reduction 54 to sharpening wheel 22 by engagement between the flats on sleeve 64 and abutting flats on extensions 70 and 72. One skilled in the art will recognize that this method of driving sharpening wheel 22 permits axial displacement of sharpening wheel 22 during rotation thereof.

Cup 50 (FIG. 7) includes a disc portion 78 having a central opening 80 fittable over step reduction 52 to permit abutment with abutment shoulder 60. A retainer washer 82 is secured on extension 52 using, for example, a C washer 84. A spring 86 is biased between disc portion 78 and retainer washer 82. An outer perimeter of disc portion 78 faces hub 48.

In the quiescent condition shown in FIG. 7, an opposition of forces is set up between resilient urging provided by spring 44 and spring 86. That is, rightward force is applied to hub 48 by spring 44 and leftward force is applied to hub 48 by spring 86, acting through disc portion 78. By design, the axial force provided by spring 86 exceeds that provided by spring 44 in the quiescent condition. Thus, leftward motion of cup 50 is limited by abutment between disc portion 78 and abutment shoulder 60. Abutment of hub 48 with disc portion 78 positively establishes the quiescent axial position of sharpening wheel 22. When an external force is applied to sharpening wheel 22 from right to left in the figure, sharpening wheel 22 moves leftward by compressing spring 44. Cup 50 remains stationary at this time due to the abutment of disc portion 78 with abutment shoulder 60. When the right-to-left force is removed, spring 44 returns sharpening wheel 22 to its inoperative position. In response to a left-to-right force, sharpening wheel 22 moves rightward by compressing spring 86. It may be noted that the diameter of retainer washer 82 is such that it can enter the interior of cup 50.

In the preferred embodiment, the force applied by spring 86 is about twice that applied by spring 44. This relationship provides substantially equal force application in the left and right directions. That is, in the leftward direction, the only resilient force acting on sharpening wheel 22 is that applied by spring 44. In the rightward direction of motion, the net force on sharpening wheel 22 is that applied by spring 86 acting in the leftward direction, minus that applied by spring 44 acting in the rightward direction. When spring forces are in the ratio of 1 to 2, then the forces are about equal for left and right deflection of sharpening wheel 22.

One skilled in the art will recognize that cup 50 could be replaced by a washer disposed in the position of disc portion 78 without departing from the spirit and scope of the invention. Also, other detailed embodiments would occur to one having the present disclosure for reference. Such other detailed embodiments should be understood to fall within the ambit of the present invention.

Figure 9:
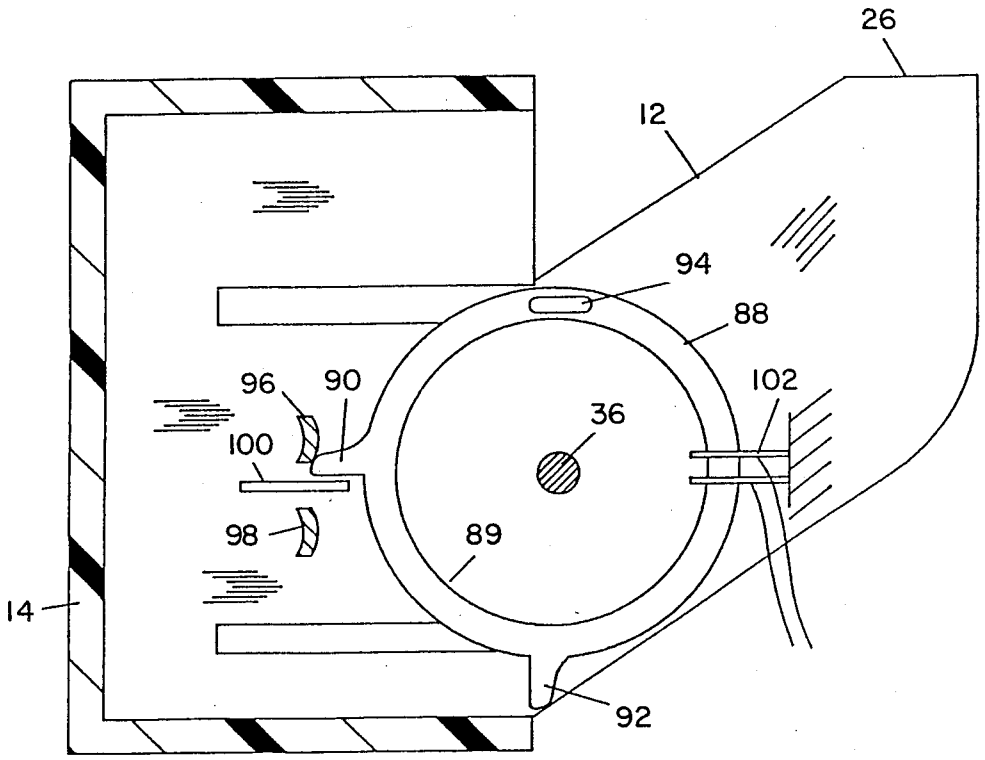
FIG. 9 is a cross section taken from within a companion appliance, with certain elements thereof removed to show relevant portions of the knife sharpener of the present invention.

Referring now to FIG. 9, a view is shown from within can opener 14, with a front portion of can opener 14 removed to show knife sharpener 12 alongside it. An annular disk 88, integral with knife sharpener 12, is supported inside can opener 14 on an annular sleeve (not shown). Annular disk 88 defines an opening 89 through which sharpening wheel 22 (not shown in FIG. 9) may pass during assembly and disassembly of the apparatus. Shaft 36 is shown passing along an axis of opening 89.

First and second detent bosses 90 and 92 extend radially outward from the perimeter of annular disk 88. In addition, a switch-actuating boss 94 extends from annular disk 88 in a direction parallel to the axis of opening 89. First and second detent springs 96 and 98 are disposed at opposed sides of a stop boss 100. A sharpener switch 102 is disposed in a position where it is contacted by switch-actuating boss 94 when knife sharpener 12 is rotated from its inoperative position shown, to its operative position.

Detent springs 96 and 98 are stationarily mounted by conventional means to can opener 14. In the preferred embodiment, these elements are cantilevered from their mounting point, in order to permit resilient deflection thereof in response to forces applied thereto by contact with detent bosses 90 and 92, respectively. It will be noted that detent springs 96 and 98 are arc shaped. Thus, after its respective detent boss passes its center, a detent spring prevents its return except upon application of a substantial application of force by the user.

In the inoperative position shown, detent boss 90 has been rotated past the center of detent spring 96 and rests stopped by contact with stop boss 100. When knife sharpener 12 is rotated to its operative position, detent boss 92 comes to rest against stop boss 100, and is held there by detent spring 98. At this time, sharpener switch 102 is closed by contact with switch-actuating boss 94, whereby the electric motor (not shown) that rotates shaft 36 is energized automatically.

Figure 10:
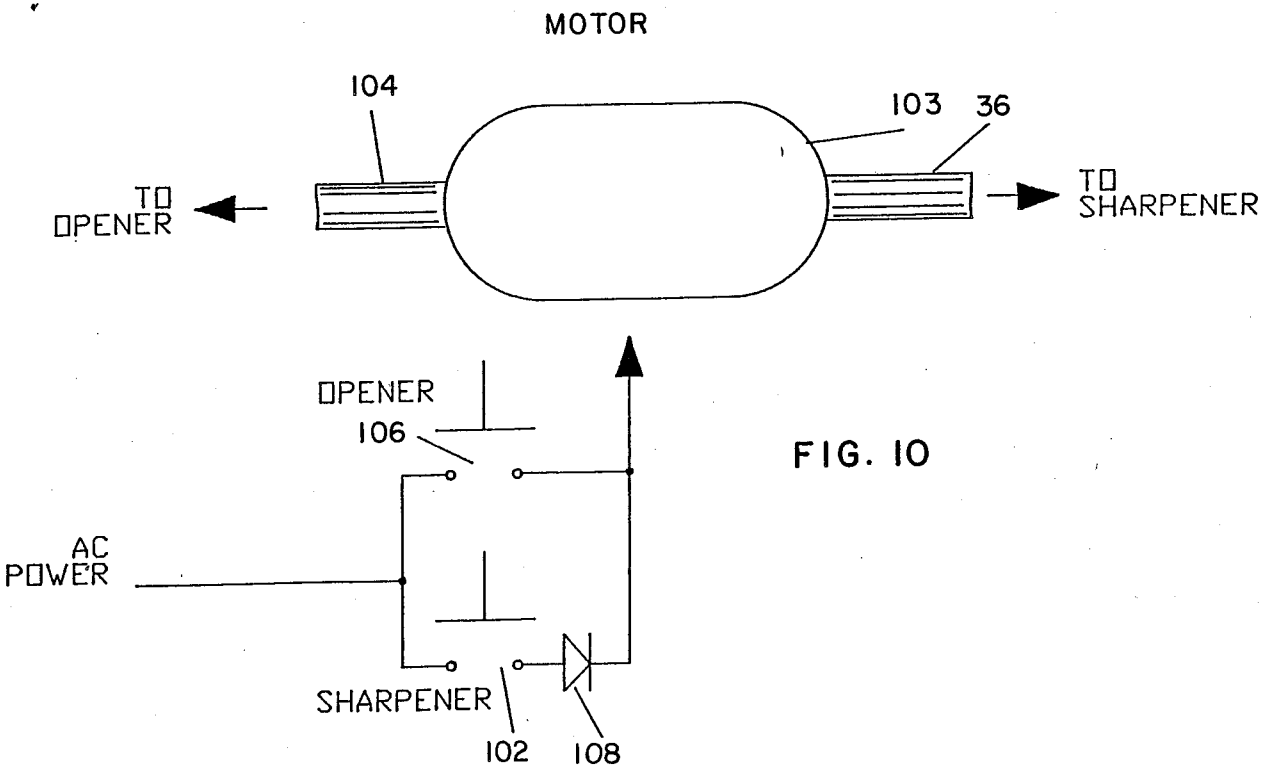
FIG. 10 is an electrical schematic diagram of the knife sharpener, and its companion appliance.

Referring now to FIG. 10, an electric motor 103 includes a first shaft 104 connected to a gearing of a can opener (not shown) and to shaft 36 rotating the sharpening wheel of the present invention. An opener switch 106 connects AC electric power directly to electric motor 103. Sharpener switch 102, in contrast, has one of its contacts connected to the source of AC power, and its second contact connected to a terminal of a rectifier diode 108. The combination of sharpener switch 102 and rectifier diode 108 is connected in parallel with opener switch 106.

In the preferred embodiment, electric motor 103 is of a type whose operating speed is responsive to an RMS value of the AC power applied thereto. One type of motor with this characteristic is a universal motor. When AC power is fed directly to electric motor 103 through opener switch 106, electric motor 103 rotates at a high speed appropriate for driving the gearing of a can opener. Conversely, when sharpener switch 102 is closed, rectifier diode 108 performs half-wave rectification on the AC power flowing therethrough. Accordingly, the RMS value of the power fed to electric motor 103 is reduced about 50 percent. As a result of the reduced amount of power fed to it, electric motor 103 rotates at a slower speed more appropriate for direct drive of a sharpening wheel 22.

The above-described embodiment of the invention requires a sharpening disk having a relatively large thickness. This, in turn, results in a substantial mass to be rotated by the motor. In some applications it may be desirable to permit the use of a thinner sharpening wheel.

Figure 11:
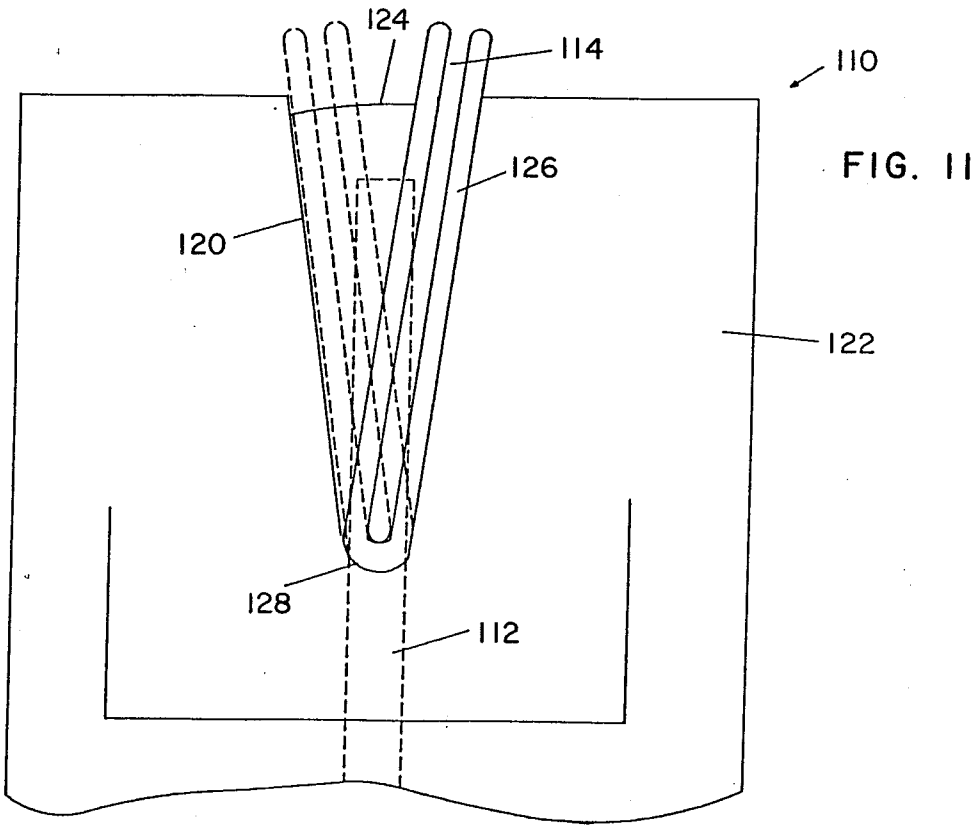
FIG. 11 is an external view of a single-slot articulating knife guide for a knife sharpener according to an embodiment of the invention.

Referring now to FIG. 11, there is shown a closeup view of a knife sharpener 110 according to a further embodiment of the invention. This embodiment permits the use of a substantially thinner sharpening wheel 112, whose location is indicated in dashed line. A single slot 114 may be positioned in either of a first position, indicated in solid line, and a second position, indicated in dashed line. As will be evident from the following, an integral detent mechanism ensures that slot 114 is retained in one of its permitted positions and is substantially prevented from remaining in any other position.

Figure 12:
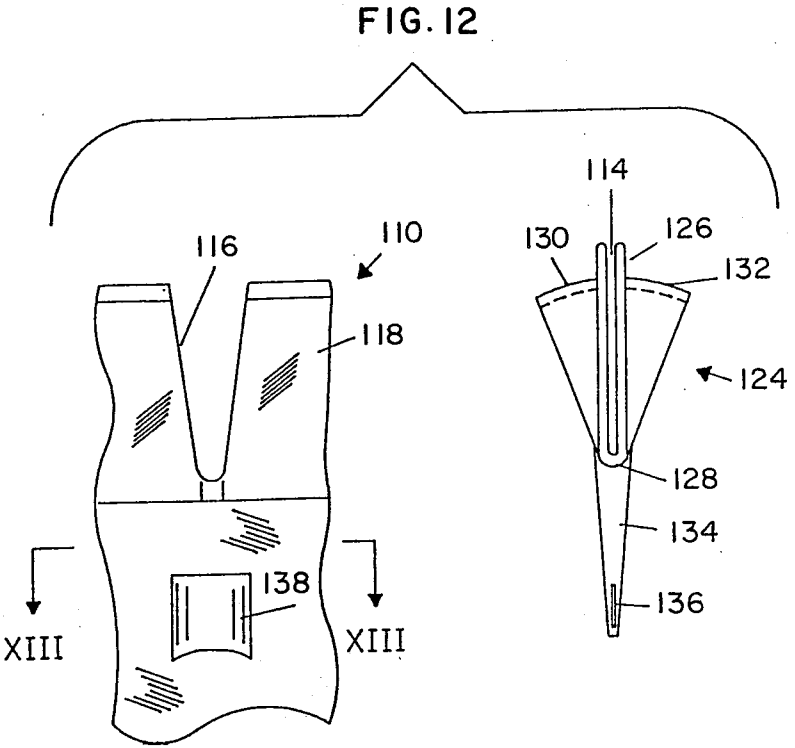
FIG. 12 is a cross section of the articulating knife guide of FIG. 11.

Referring now also to FIG. 12, a cross section of knife sharpener 110 reveals a V-shaped slot 116 in an end wall 118 of knife sharpener 110. A corresponding V-shaped slot 120 is seen in the other end wall 122, the exterior of which is shown in FIG. 11. Slot 114 is formed in a reciprocating assembly 124, best seen at the right in FIG. 12. Slot 114 is surrounded by a substantial lip 126 which forms a rounded outer bottom 128 at the inner end of slot 114. A corresponding lip is formed at the opposite end of slot 114, but is hidden in the figures.

First and second arc plates 130 and 132 are disposed adjacent the sides of lip 126. A detent leg 134 extends downward from the far end of reciprocating assembly 124. A detent boss 136 is disposed centrally in detent leg 134 near an outer extremity thereof. An arcuate detent plate 138 extends upward from end wall 118. Arcuate detent plate 138 is preferably integrally formed with end wall 118, but may be a separate part, if desired. Arc plates 130 and 132 deny access to the interior of the apparatus and prevent the escape of grinding by-products.

Figure 13:
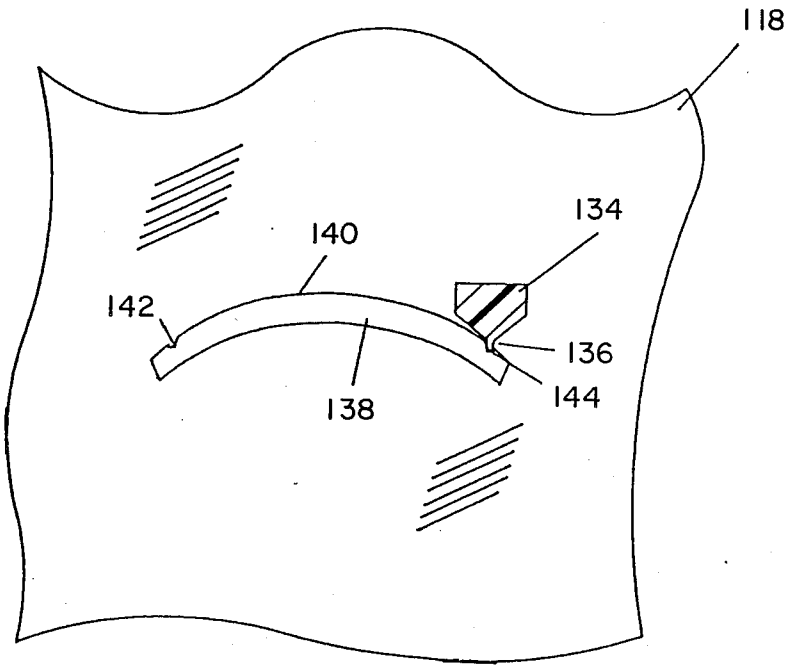
FIG. 13 is a cross section taken along XIII—XIII in FIG. 12.

Referring now to FIG. 13, when assembled, detent boss 136 contacts a cam surface 140 of arcuate detent plate 138. First and second notches 142 and 144 are disposed at opposed ends of cam surface 140. The relative positions of arcuate detent plate 138 and detent leg 134 are such that a substantial preload is applied to detent leg 134, whereby a resilient force is established for maintaining a substantial contact force therebetween. Such preload is enhanced by making reciprocating assembly 124 and/or detent plate 138 from a generally rigid material such as, for example, Nylon. A curvature of cam surface 140 is selected such that the contact between detent boss 136 and cam surface 140 tends to urge detent boss 136 to one end or the other of cam surface 140. When detent boss 136 reaches one of its two permitted positions, it engages notch 142 or notch 144. Rotation is stopped by contact of lip 126 with the edges of V-shaped slot 116 and V-shaped slot 120.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electric sharpener comprising: an electric motor having a shaft;

a sharpening wheel operatively connected to said motor shaft whereby said sharpening wheel rotates with said shaft;

means for guiding a blade selectively to first and second surfaces of said sharpening wheel;

said first surface of said sharpening wheel positioned with respect to said guiding means so that the insertion of said blade in said guiding means in contact with said first surface of said sharpening wheel will apply axial force to said sharpening wheel in a first axial direction;

said second surface of said sharpening wheel positioned with respect to said guiding means so that the insertion of said blade in said guiding means in contact with said second surface of said sharpening wheel will apply axial force to said sharpening wheel in a second axial direction;

means for permitting said sharpening wheel to translate substantial distances in said first and second axial directions;

first resilient means for urging said sharpening wheel in said first axial direction;

second resilient means for urging said sharpening wheel in said second axial direction;

means for limiting the displacement of said first resilient means in said first direction to position said sharpening wheel at a nominal position with respect to said guiding means;

said second resilient means being effective for resisting motion of said sharpening wheel when said sharpening wheel is displaced from said nominal position in said first direction; and said first resilient means being effective for resisting motion and said second resilient means being effective for encouraging motion of said sharpening wheel when said sharpening wheel is displaced from said nominal position in said second direction.

2. An electric sharpener according to claim 1 wherein:

said first resilient means has a first spring constant substantially equal to twice a second spring constant of said second resilient means; and both said first resilient means and said second resilient means are compressed when said sharpening wheel is in said nominal position so that the pre-load forces on both resilient means are equal.

3. An electric sharpener comprising: a motor having a shaft;

a sharpening wheel operatively connected to said motor shaft;

a sharpener housing formed to provide an aperture through which access to both faces of said sharpening wheel is gained;

a reciprocating guide means formed to provide a slot;

means for disposing said reciprocating guide means so that said slot is positioned selectively at first or second inclined positions with respect to said sharpening wheel and said guide means shrouds said housing aperture except at location of said slot;

said first position permitting contact between a blade and a first surface of said sharpening wheel;

said second position permitting contact between said blade and a second surface of said sharpening wheel;

said reciprocating guide means including a detent leg;

a detent plate affixed to said sharpener housing;

said detent leg containing a detent;

said detent leg including means for resilient urging said detent thereof against a surface of said detent plate; and said detent leg and said detent plate including cooperating means for establishing said first and second position and for effectively denying stable position of said slot in other position.

4. An electric sharpener according to claim 3 wherein said detent leg is formed integrally with said reciprocating guide means.

5. An electric sharpener according to claim 4 wherein said means for resilient urging includes said reciprocating assembly and said detent leg being of a semi-rigid resilient plastic.

6. An electric sharpener according to claim 3 wherein:

said cooperating means includes an arcuate cam surface of said detent plate;

said detent leg contacting said arcuate cam surface and being urged toward one of a first and second end thereof;

a first detent notch at said first end;

a second detent notch at said second end; and said detent leg including a detent boss selectively engageable with said first and second detent notches for maintaining said slot in a selected one of said first and second positions.

7. A sharpening appliance comprising:

a bracket adapted to be mounted in a fixed position under a horizontal surface;

a housing adapted to be pivoted with respect to said bracket about a pivot axis between an operative and a closed position;

a motor mounted on said bracket, having a shaft;

a sharpening wheel mounted on said motor shaft;

said motor and said sharpening wheel being mounted on said shaft so that said pivot axis coincides with the axis of said motor shaft, and wherein said housing defines one of more slots for receiving a blade to be sharpened and for controlling the position of said blade with respect to said sharpening wheel, and wherein said slots are accessible to a user only when said housing is in said operative position.

8. A sharpening appliance according to claim 7, further comprising a means for powering said motor upon pivoting of said housing to said operative position.

9. A sharpening appliance comprising:

a sharpening wheel;

a sharpener housing having a circular aperture in a sidewall thereof, a second appliance having an orifice aligned with said circular aperture, said second appliance housing being suspended from a horizontal surface, whereby said sharpener housing pivots about a center axis of said aperture, and whereby said sharpener housing is attached to said second appliance housing, said sharpener housing being adapted to provide external access to said sharpening wheel;

an electric motor, having a shaft protruding from both sides of a casing of said electric motor, said electric motor being positioned within said second appliance housing so that one protruding end of said motor shaft extends through said aperture into said sharpener housing, said motor shaft being adapted at one end to drive said sharpener wheel, said motor shaft adapted at the other end to drive a second tool, wherein said second tool is driven by said motor at a speed different from a speed at which said motor drives said sharpening wheel, and wherein rotation of said sharpener housing about said center axis actuates a switch for controlling the speed of said motor.

10. A sharpening appliance according to claim 9, further including a means for powering an electric motor which comprises:

a first switch means effective for connecting an AC source directly to said electric motor and positioned so that a user may actuate said first switch when said user desires to use said second tool;

a second switch means located within said housing whereby rotation of said housing actuates said second switch means, said second switch means being effective for connecting an AC source to a half-wave rectifying diode in series with said electric motor so that said electric motor receives less RMS electric power than it receives through said first switch means.

* * * * *